US006860717B2

(12) United States Patent
Schipani et al.

(10) Patent No.: US 6,860,717 B2
(45) Date of Patent: Mar. 1, 2005

(54) AXIAL TURBINE FOR AERONAUTICAL APPLICATIONS

(75) Inventors: Claudia Schipani, Turin (IT); Ennio Spano, Turin (IT); Domenico Dalle Crode, Turin (IT)

(73) Assignee: Avio S.p.A., Turin (IT)

( * ) Notice: Subject to any disclaimer, the term of this patent is extended or adjusted under 35 U.S.C. 154(b) by 0 days.

(21) Appl. No.: 10/063,760

(22) Filed: May 10, 2002

(65) Prior Publication Data

US 2002/0182064 A1 Dec. 5, 2002

(30) Foreign Application Priority Data

May 11, 2001 (IT) ..... TO2001A0444

(51) Int. Cl.[7] ..... F01D 17/16
(52) U.S. Cl. ..... 415/160
(58) Field of Search ..... 415/160, 148, 415/149.4, 151, 159, 162

(56) References Cited

U.S. PATENT DOCUMENTS

| | | | | | |
|---|---|---|---|---|---|
| 2,842,305 | A | * | 7/1958 | Eckenfels et al. | 415/160 |
| 2,933,234 | A | | 4/1960 | Neumann | 230/114 |
| 2,950,084 | A | | 8/1960 | Perry | 253/78 |
| 3,074,689 | A | | 1/1963 | Chapman | 253/78 |
| 3,303,992 | A | | 2/1967 | Johnson | 230/114 |
| 3,356,288 | A | * | 12/1967 | Corsmeier | 415/160 |
| 3,376,018 | A | * | 4/1968 | Williamson | 415/160 |
| 3,558,237 | A | * | 1/1971 | Wall, Jr. | 415/160 |
| 3,584,458 | A | | 6/1971 | Wetzler | 60/39.02 |
| 3,736,070 | A | * | 5/1973 | Moskowitz et al. | 415/160 |
| 3,788,763 | A | | 1/1974 | Nickles | 415/147 |
| 3,850,544 | A | | 11/1974 | Ciokajlo | 415/149 |
| 4,695,220 | A | * | 9/1987 | Dawson | 415/160 |
| 4,836,746 | A | | 6/1989 | Owsianny et al. | 415/160 |
| 4,990,056 | A | * | 2/1991 | McClain et al. | 415/160 |
| 5,466,122 | A | | 11/1995 | Charbonnel et al. | 415/160 |
| 5,517,817 | A | | 5/1996 | Hines | 60/39.75 |

FOREIGN PATENT DOCUMENTS

| | | | |
|---|---|---|---|
| EP | 0 909 880 | 4/1999 | F01D/17/16 |
| EP | 1 031 703 A2 | 8/2000 | F01D/17/16 |
| FR | 1053647 | 4/1952 | 5/8 |
| GB | 805015 | 11/1958 | 110/2 |

OTHER PUBLICATIONS

PCT Search Report dated Jan. 23, 2004.

* cited by examiner

*Primary Examiner*—Edward K. Look
*Assistant Examiner*—Richard A. Edgar
(74) *Attorney, Agent, or Firm*—Howrey, Simon, Arnold & White, LLP; Stephen H. Cagle

(57) ABSTRACT

An axial turbine for aeronautical applications has a casing housing a stator, which is provided with an array of airfoil profiles, which are positioned angularly equidistant from one other about the axis of the turbine, define associated spaces between one another for the passage of a flow of gas and are hinged to an annular structure, each one about an associated hinge axis incident to the axis of the turbine; in service, the airfoil profiles are simultaneously actuated to rotate by an identical angle of adjustment by means of a ring actuated by actuators outside the casing and connected to each airfoil profile via an associated lever.

3 Claims, 3 Drawing Sheets

Fig.3
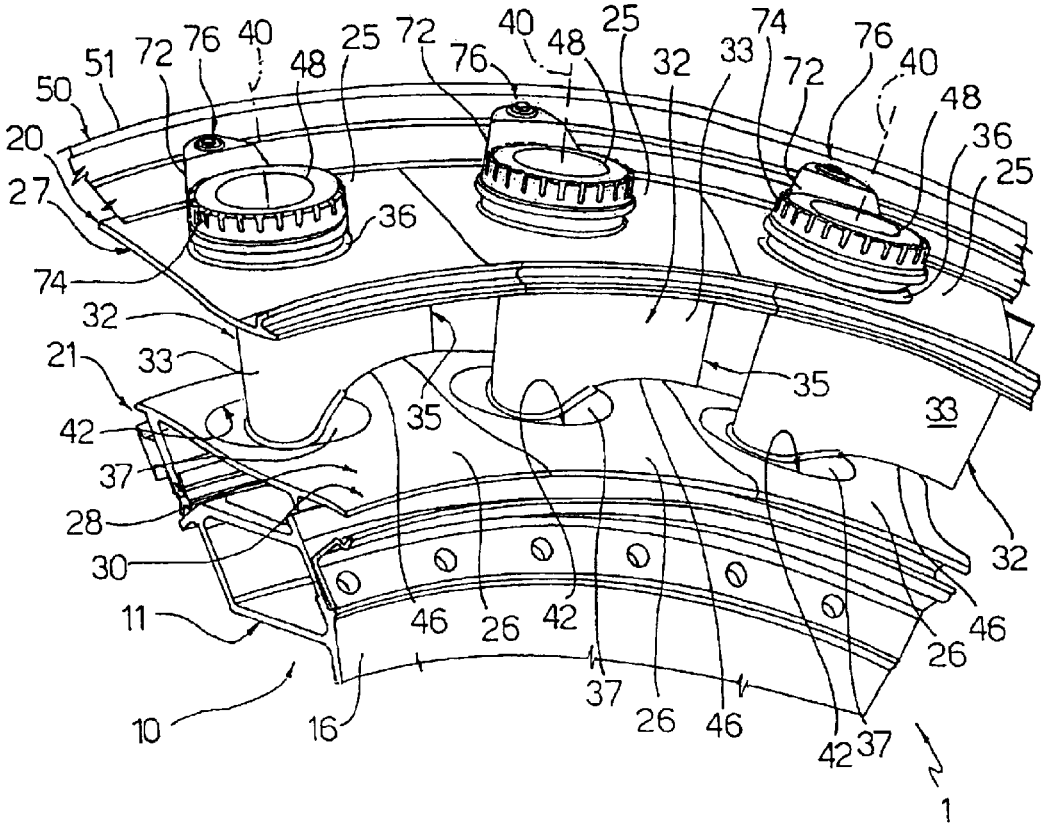
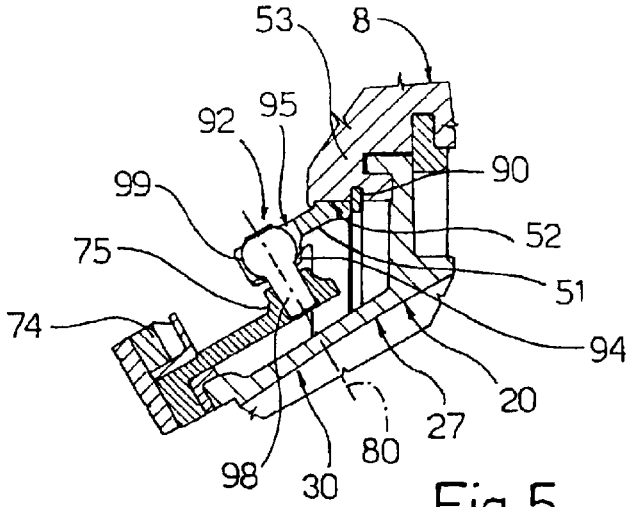
Fig.5

AXIAL TURBINE FOR AERONAUTICAL APPLICATIONS

CROSS REFERENCE TO RELATED APPLICATIONS

This application claims priority under 35 USC §119 of application number TO2001A 00444, filed May 11, 2001 in Italy.

BACKGROUND OF INVENTION

The present invention relates to an axial turbine for aeronautical applications and, in particular, for an aeronautical jet engine.

As is known, an aeronautical engine comprises a compressor unit, a combustion chamber arranged downstream from the compressor unit and a turbine unit, which is in turn arranged downstream from the combustion chamber and, generally, comprises three axial turbines, which are designated as high-, medium- and low-pressure turbines depending upon the pressure of the gas passing through them.

Each axial turbine comprises a succession of stages, each one of which consists of a stator comprising an array of fixed vanes and a rotor comprising an array of vanes that rotate about the axis of the turbine.

The efficiency of a known axial turbine and consequently of the associated aeronautical engine varies substantially as a function of the various operating conditions of the aeronautical engine itself.

Indeed, the flow rate and thus the velocity of the gas passing through the turbine stages vary as a function of engine operating conditions, while the geometry and relative position of the vanes of the stages themselves are set at the design stage in accordance with a fixed compromise configuration so as to achieve a satisfactory average efficiency for any gas flow rate and for any engine operating condition.

It has been found necessary to improve turbine efficiency and thus the overall efficiency of the associated aeronautical engine under the various operating conditions of the engine.

SUMMARY OF INVENTION

The purpose of the present invention is to produce an axial turbine for aeronautical applications, which turbine allows said requirement to be met in a simple and functional manner.

The present invention provides an axial turbine for aeronautical applications having an axis of symmetry and comprising a case and at least one stator housed in said case and comprising a support structure and an array of airfoil profiles positioned angularly equidistant from one other about said axis of symmetry and defining respective spaces between them for passage of a flow of gas, and means for connecting each said airfoil profile to said support structure, characterised in that said connecting means comprise hinge means to permit each said airfoil profile to rotate relative to said support structure about an associated first hinge axis incident to said axis of symmetry, and in that it also comprises angular positioning means for simultaneously rotating said airfoil profiles about said respective first hinge axes by an identical angle of adjustment.

BRIEF DESCRIPTION OF DRAWINGS

The invention will now be described with reference to the attached drawings, which illustrate a non-limiting embodiment of the invention, in which:

FIG. 3 is a partial front perspective view of the turbine in FIG. 1;

FIG. 5 is an analogous figure to FIG. 2 and illustrates, with some parts removed for clarity, a variant of the turbine in the preceding figures.

DETAILED DESCRIPTION

Figure 1:
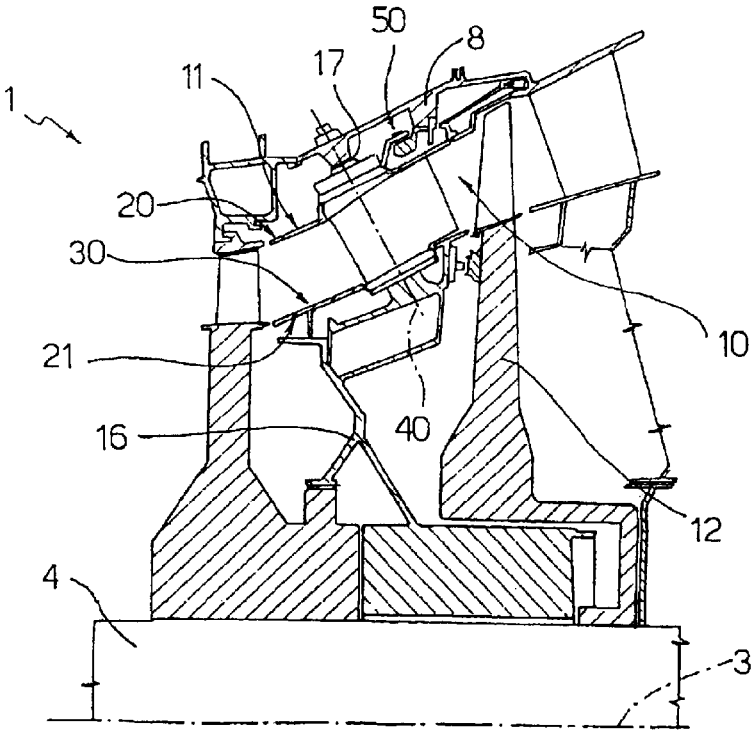
FIG. 1 is a partial schematic radial section of a preferred embodiment of the axial turbine for aeronautical applications produced according to the invention.

In FIG. 1, the number 1 indicates an axial turbine (shown schematically and in part), which is part of an aeronautical engine (not shown) comprising a compressor unit, a combustion chamber arranged downstream from the compressor unit and a turbine unit. The turbine unit is in turn arranged downstream from the combustion chamber and comprises three turbines respectively of high, medium and low pressure through which there passes an axial flow of expanding gases produced in the combustion chamber.

The turbine 1 in particular defines the medium-pressure turbine of the associated aeronautical engine, has an axis 3 of symmetry coincident with the axis of the engine itself and comprises an engine shaft 4 rotatable about the axis 3 and a case or casing 8 housing a succession of coaxial stages, only one of which is denoted 10 in FIG. 1.

Figure 2:
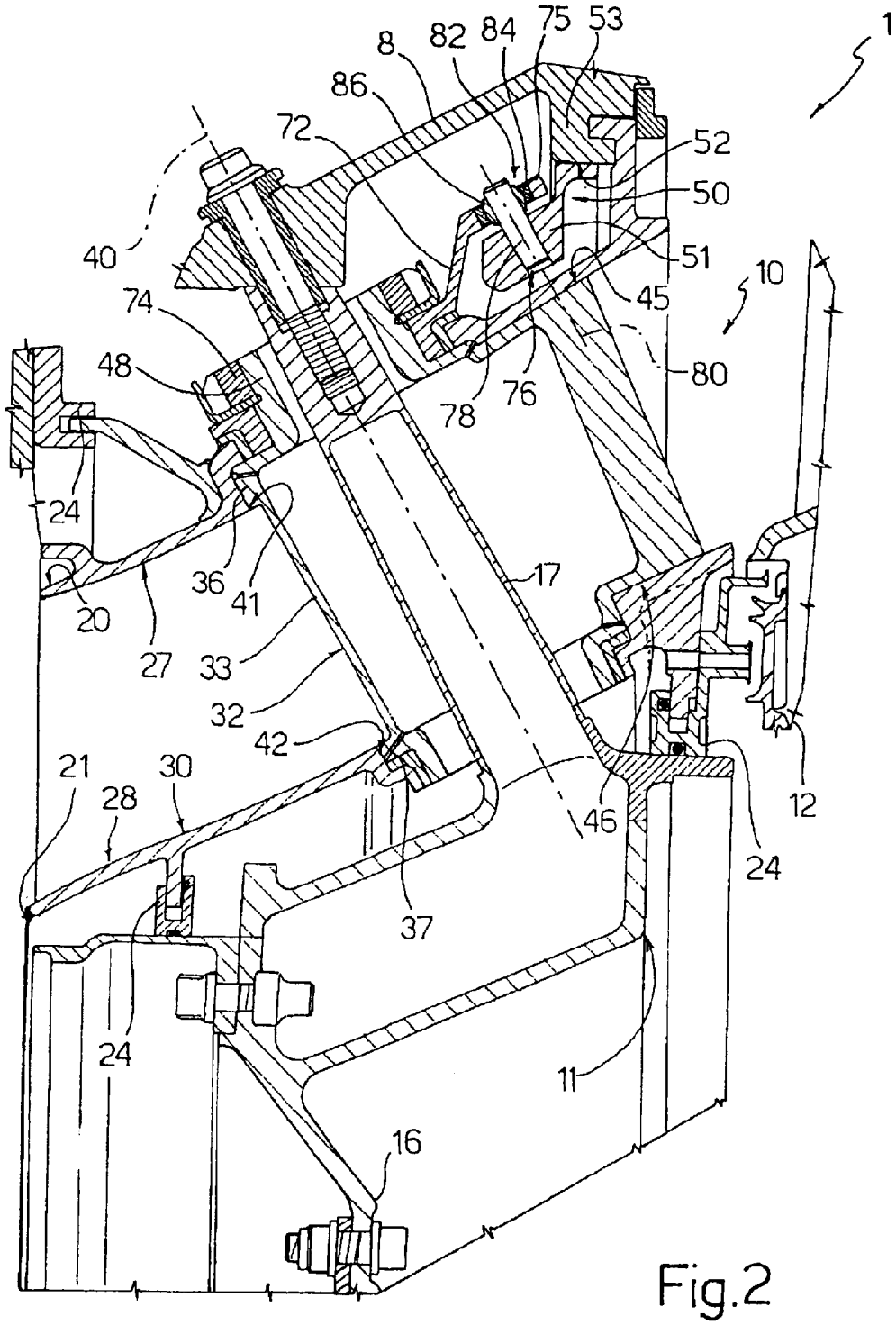
FIG. 2 is a radial section analogous to FIG. 1 and illustrates a specific feature of the turbine in FIG. 1 at a larger scale.

With reference to FIGS. 1 and 2, the stage 10 comprises a stator 11 and a rotor 12 keyed to the engine shaft 4 downstream from the stator 11. The stator 11 in turn comprises a hub 16 (shown schematically and in part), which is integrally connected to the casing 8 by means of a plurality of spokes 17 (FIG. 2) angularly equidistant from one another about the axis 3 and supports the engine shaft 4 in known manner.

With reference to FIGS. 2 and 3, the stator 11 also comprises two annular platforms or walls 20, 21, which are arranged in mutually facing positions between the hub 16 and the casing 8, have the spokes 17 passing through them and are coupled one with the casing 8 and the other with the hub 16 in substantially fixed datum positions by means of connecting devices 24 that impart degrees of axial and/or radial freedom to said walls 20, 21 with respect to the casing 8 and the hub 16 in order to compensate, in service, for the differences in thermal expansion between the various components.

The walls 20, 21 each comprise an associated plurality of sectors 25, 26 that are circumferentially adjacent to one another (FIG. 3) and have respective surfaces 27, 28 facing each other, which radially delimit an annular duct 30 with a diameter increasing in the direction of travel of the flow of gas.

The walls 20, 21 carry an array of hollow vanes 32, which are angularly equidistant from one another about the axis 3, have the spokes 17 passing through them and comprise respective airfoil profiles 33 housed in the duct 30, circumferentially delimiting between them a plurality of spaces 35 to allow passage of the flow of gas (FIG. 3).

As shown in FIG. 2, each vane 32 also comprises an associated pair of hinging flanges 36, 37, which are tubular, cylindrical, arranged on opposite sides of the associated profile 33 and integral with the profile 33 itself. The flanges 36, 37 of each vane 32 are mutually coaxial along an axis 40, which is substantially orthogonal to the surfaces 27, 28 and incident to the axis 3 and forms an angle other than 90° to said axis 3, said flanges engaging in respective circular seats 41, 42 made in the walls 20 and 21, respectively, to permit the profile 33 to rotate about the axis 40 relative to said walls 20, 21.

Each profile 33 comprises a tail portion delimited by a top surface 45 slidably coupled with the surface 27 and by a base surface 46 slidably coupled with the surface 28.

The zones of the surfaces 27 and 28 to which surfaces 45 and 46 respectively are coupled have a shape complementary to respective ideal surfaces defined by the rotation about the axes 40 of the median lines of said surfaces 45 and 46.

The flange 36 of each vane 32 ends in a threaded cylindrical section 48, which is coaxial with the flange 36 itself and is connected to an angular positioning and synchronising unit 50 capable of rotating the vanes 32 simultaneously about their respective axes 40 through the same angle, keeping the profiles 33 in the same orientation to each other.

The unit 50 is part of the turbine 1 and comprises a mobile synchronising ring 51 arranged around the wall 20 and slidably coupled With a guide track 52, which delimits an internal portion 53 of said casing 8 and keeps the ring 51 in a fixed radial position coaxial with the axis 3.

In order to limit friction forces, a layer of a material that can withstand the in-service temperatures of the turbine 1 and has a relatively low coefficient of friction is interposed between the ring 51 and the portion 53. According to a variant that is not illustrated, a series of rolling elements, preferably spaced apart from each other circumferentially by a cage, is interposed between the ring 51 and the portion 53.

Figure 4:
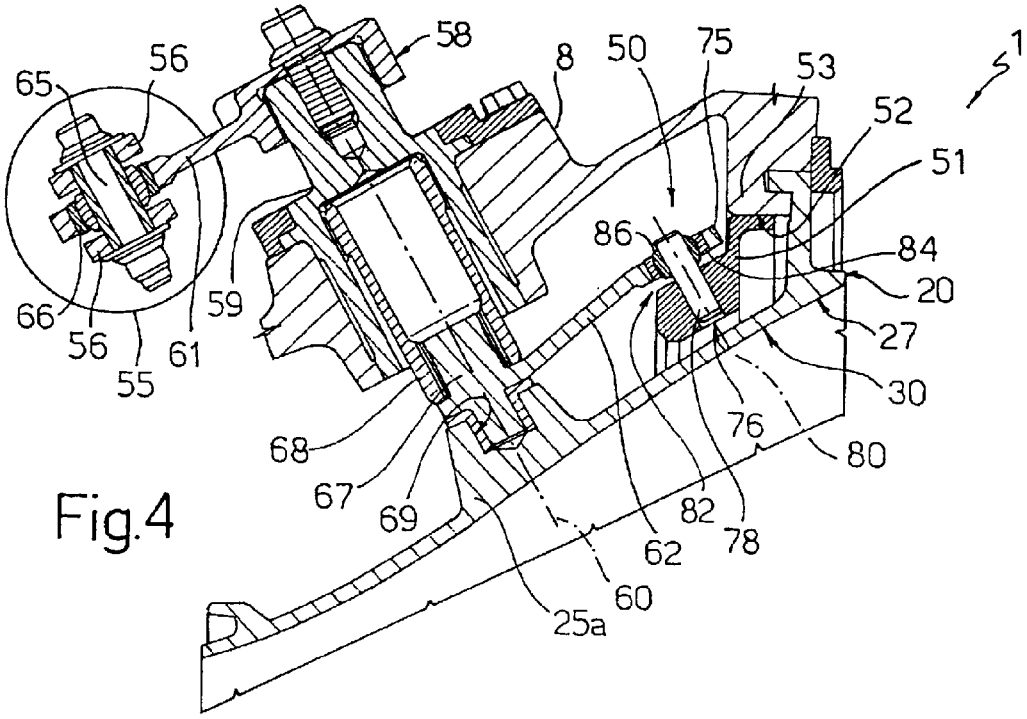
FIG. 4 is a different radial section of the turbine in FIGS. 1 and 2 and illustrates another specific feature of the turbine.

As shown in FIG. 4, the unit 50 also comprises two actuators 55 known per se arranged outside the casing 8 in mutually diametrically opposite positions, only one of which is shown schematically.

The actuators 55 are connected in a known manner (not shown), for example by hinges, to a fixed frame, in particular to the casing 8 of the turbine 1 and each comprise an associated end fork 56 movable in a direction substantially tangential relative to the axis 3.

The actuators 55 cause the ring 51 to rotate about the axis 3 in both directions by means of associated interposed lever transmissions 58, only one of which is shown in FIG. 4.

The transmission 58 is part of the unit 50 and comprises a cylindrical transmission body 59, which has an axis 60 that is incident to the axis 3 and forms, together with said axis 3, an angle equal to that formed by the axes 40. The body 59 extends axially through the casing 8 in an intermediate position between the ring 51 and the fork 56; it is connected to the casing 8 in a fixed axial position and in angularly rotatable manner and carries two opposed radial levers 61, 62. The lever 61 is fixed, at one end, to the body 59 and is connected at the opposite end to the fork 56 by means of a hinge pin 65 carried by said fork 56 and a ball joint 66 interposed between the pin 65 and the lever 61. The lever 62, on the other hand, is housed in the casing 8, comprises an end portion 67, which is coaxial with the body 59, is connected to said body 59 in a fixed angular position by axial interposition of a grooved sleeve 68 and engages, in rotatable manner about the axis 60, in a blind positioning seat 69 made in a sector 25*a*.

As shown in FIGS. 2 and 3, the ring 51 is connected to each vane 32 by means of an associated lever 72, which extends radially relative to the axis 40 of the portion 48 towards the ring 51 and is fixed to the vane 32 by means of a locking ring 74 screwed to said portion 48.

With reference to FIGS. 2 and 4, the levers 62, 72 have respective end portions 75 connected to the ring 51 by means of respective connecting devices 76 that are part of the unit 50.

Each device 76 comprises an associated hinge pin 78, which is integral with the ring 51 and has an axis 80 that is incident to the axis 3 and forms, with said axis 3, an angle equal to that formed by the axes 40, 60.

Each device 76 also comprises an associated ball joint or bearing 82, which in turn comprises a spherical seat 84 fixed to the associated end portion 75 and a spherical head 86, which engages rotatably in the spherical seat 84 and is fitted slidingly on the associated pin 78.

During rotation of the ring 51 about the axis 3, each ball joint 82 compensates for the differences in relative orientation between the lever 62, 72 and the pin 78. At the same time, the sliding connection between the spherical heads 86 and the pins 78 and that between the ring 51 and the track 52 makes it possible to compensate for the differences in trajectory of the levers 62, 72 in the radial direction relative to the ring 51 and in the axial direction relative to the axis 3 respectively.

According to the variant shown in FIG. 5, the ring 51 is held by a retaining device 90 in a fixed axial position relative to the track 52, while the devices 76 are replaced by respective connecting devices 92, each comprising an associated fork 94 integral with the ring 51 and defining a radial slot 95 relative to the axis 3. Each device 92 also comprises an associated hinge pin 98, which differs from the pin 78 in that it is integrally joined to the end portion 75 of the associated lever 62, 72 and in that it comprises an integral spherical end portion 99, which is connected slidably against two flat surfaces facing each other, which define the slot 95.

The sliding connection between the spherical portion 99 and the fork 94 allows compensation both of the differences in relative orientation and the differences in trajectory in radial and axial directions between the levers 62, 72 and the ring 51 during the rotation of said ring 51.

With reference to FIGS. 1 to 4, during assembly of the turbine 1, once the vanes 32 have been mounted between the associated sectors 25, 26 and the ring 51 provided with the pins 78 has been fitted around the wall 20, the levers 72 are fitted on the portions 48 while simultaneously sliding the spherical heads 86 onto the associated pins 78. The levers 72 are then fixed to the vanes 32, keeping the profiles 33 identically oriented about the respective axes 40, while the levers 62 are connected to the wall 20 by inserting the end portions 67 into the seats 69. Once the stator 11 has been connected to the casing 8, the remaining transmissions 58 to be connected to the actuators 55 are mounted.

With regard to the variant in FIG. 5, once the levers 72 have been fixed to the vanes 32, the ring 51 is connected axially to the stator 11, while fitting the forks 94 directly onto the spherical portions 99 of the pins 98, said ring finally being locked radially relative to the track 51. By using the device 92 to connect the levers 72 to the ring 51, the levers 72 themselves are mounted directly and solely on the casing 8, without it being necessary to produce the seats 69 of the sectors 25*a* by means of a die-casting die differing from that provided for the other sectors 25.

In service, the actuators 55 are operated so as to vary the angular position of the ring 51 continuously or discontinuously about the axes 3 and, thus, the ring 51 synchronously effects rotation of the vanes 32 about their respective axes 40 by an identical angle of adjustment, so keeping the profiles 32 in identically oriented positions relative to one another about said axes 40.

Rotation of the profiles 33 modifies the geometry of the spaces 35 and, in particular, modifies the minimum area for passage of the gases in each space 35, said area being defined by the extent to which the trailing edge of one profile 33 projects onto the dorsal face of the adjacent profile 33 and commonly being designated the "throat area".

With particular reference to the front perspective view in FIG. 3, clockwise rotation of the ring 51 and thus of the profiles 33 brings about a reduction in the passage area of each space 35 and thus a reduction in the gas flow rate through the stage 10. Conversely, anticlockwise rotation of the ring 51 brings about an increase in the passage area of each space 35 and thus an increase in the gas flow rate.

It is clear from the above that, by hinging the profiles 33 to the walls 20, 21 and rotating said profiles 33 by means of the unit 50, it is possible to create a variable-geometry axial turbine 1 that is more efficient than known, fixed-geometry axial turbines. Indeed, synchronously rotating the profiles 33 to vary the passage area of the spaces 35 makes it possible to adjust the gas flow rate through the stage 10, as a result of which the turbine 1 can operate under optimal conditions whatever the operating conditions of the associated aeronautical engine.

Using the ring 51 makes it possible to synchronise the rotation of the profiles 33 about their respective axes 40 in a simple and precise manner, while the devices 76, 92 transmit the rotational motion between the ring 51 and the levers 62, 72, said devices being rotatable about the mutually incident axes without jamming and simultaneously with very tight clearances. Indeed, it is essential for the components of the unit 50 to be relatively rigid and to be interconnected with tight clearance, but with the least possible friction forces in order to ensure that angular displacement of the profiles 33 is accurate and always identical for all profiles in the presence of elevated operating temperatures.

In particular, as already explained, the devices 92 permit very simple and relatively fast mounting of the unit 50 on the turbine 1. At the same time, the pin 98 provides substantially punctiform contact between the actual spherical portion 99 and the fork 94, said contact being distinguished by relatively low friction forces, and allows coupling clearance to be limited where the spherical portion 99 is made in a single piece with the pin 98, i.e. without using a spherical head fitted on said pin.

Moreover, the particular structure defined by the walls 20, 21 and by the hub 16 means that the stresses may be led from the engine shaft 4 into the casing 8 via the spokes 17, but not via the vanes 32.

Finally, on the basis of the above, it is clear that modifications and variations can be made to the turbine 1 described and illustrated without extending it beyond the scope of protection of the present invention.

In particular, the unit 50 could differ from that described and illustrated by way of example. The devices 76 and/or 92 could differ from those illustrated, for example the spherical head 86 of the pin 78 could be connected to a fork carried by the associated lever 72 and be radial relative to the associated axis 40, instead of engaging in the spherical seat 84, and/or the transmissions 58 could be other than of the lever type.

Moreover, the vanes 32 could be of a shape other than that illustrated and/or be hinged to the walls 20, 21 in a manner other than that shown.

What is claimed is:

1. An axial turbine (1) for aeronautical applications having an axis of symmetry (3) and comprising a case (8) and at least one stator (11) housed in said case (8) and comprising a support structure (16, 20, 21) and an array of airfoil profiles (33) positioned angularly equidistant from one other about said axis of symmetry (3) and defining respective spaces (35) therebetween for passage of a flow of gas, and means (36, 37, 41, 42) for connecting each said airfoil profile (33) to said support structure (16, 20, 21); characterised in that said connecting means (36, 37, 41, 42) comprise hinge means (36, 37, 41, 42) to permit each said airfoil profile (33) to rotate relative to said support structure (16, 20, 21) about an associated first hinge axis (40) incident to said axis of symmetry (3), and in that the axial turbine also comprises angular positioning means (50) for simultaneously rotating said airfoil profiles (33) about said respective first hinge axes (40) by an identical angle of adjustment, and further characterised in that said angular positioning means (50) comprise actuating means (55) and synchronising means (51) interposed between said actuating means (55) and said airfoil profiles (33) and further characterised in that said synchronising means (51) comprise a synchronising ring (51) that is rotatable about said axis of symmetry (3) and in that said angular positioning means (50) also comprise first transmission means (72, 76) interposed between each said airfoil profile (33) and said synchronising ring (51) and second transmission means (58) interposed between said actuating means (55) and said synchronising ring (51) and further characterised in that said first transmission means (72, 76) comprise a control lever (72) that is radial with respect to the associated first hinge axis (40) and integral with said associated airfoil profile (33) and further characterised in that at least one of said first (72, 76) and second (58) transmission means comprise connecting and relative mobility means (76; 92) interposed between each said lever (62, 72) and said synchronising ring (51) to transmit the rotational motion and, in service, to compensate for differences in trajectory/orientation between said synchronising ring (51) and each said lever (62, 72) during rotation and further characterised in that said connecting and relative mobility means (76; 92) comprise a hinge pin (78; 98) interposed between said associated lever (62, 72) and said synchronising ring (51) and having a joint axis (80) incident to said axis of symmetry (3) and a spherical head (86; 99) interposed between said hinge pin (78; 98) and one of said associated levers (62, 72) and said synchronising ring (51) and further characterised in that said synchronising ring (51) is coupled with said case (8) in a fixed axial position; said connecting and relative mobility means (76; 92) comprising an elongate seat (95) made in one (72) of said levers (62, 72), and said synchronising ring (51); and the elongated seat engaged slidingly by said spherical head (99).

2. Turbine according to claim 1, characterised in that said hinge pin (98) is integral with said associated lever (62, 72); said elongate seat (95) being defined by a slot parallel to said axis of symmetry (3) and carried by said synchronising ring (51).

3. Turbine according to claim 1, characterised in that said elongate seat (95) is defined by a fork (94).

* * * * *